US007448185B2

(12) United States Patent
Zeedyk et al.

(10) Patent No.: US 7,448,185 B2
(45) Date of Patent: Nov. 11, 2008

(54) METHOD AND APPARATUS FOR MAKING PACKAGES WITH INTERNAL HEADERS FROM PREFORMED BAGS

(75) Inventors: Derek J. Zeedyk, Canton, OH (US); Bernard Lerner, Aurora, OH (US); Kent McDonald, Chagrin Falls, OH (US); Mike Coleman, North Olmsted, OH (US); Gregg Mertens, Parma Heights, OH (US)

(73) Assignee: Automated Packaging Systems, Inc., Streetsboro, OH (US)

( * ) Notice: Subject to any disclaimer, the term of this patent is extended or adjusted under 35 U.S.C. 154(b) by 0 days.

(21) Appl. No.: 11/405,750

(22) Filed: Apr. 18, 2006

(65) Prior Publication Data

US 2007/0240386 A1 Oct. 18, 2007

(51) Int. Cl.
*B65B 9/00* (2006.01)
*B65B 5/10* (2006.01)
*B65B 61/20* (2006.01)

(52) U.S. Cl. ..... 53/459; 53/452; 53/469; 53/474; 53/475

(58) Field of Classification Search ..... 53/450, 53/452, 459, 469, 474, 475, 237, 238, 451, 53/551; 206/820, 390
See application file for complete search history.

(56) References Cited

U.S. PATENT DOCUMENTS 2,878,849 A * 3/1959 Lingenfelter et al. ..... 383/9
3,254,468 A 6/1966 Lerner
3,254,828 A 6/1966 Lerner
3,319,538 A 5/1967 Bodolay et al.
3,589,913 A * 6/1971 Rosenberg ..... 426/394
3,749,237 A * 7/1973 Dorton ..... 206/438
3,791,573 A * 2/1974 Titchenal et al. ..... 229/69
3,815,318 A 6/1974 Lerner
3,844,409 A * 10/1974 Bodolay et al. ..... 206/459.5
3,882,656 A * 5/1975 Lerner ..... 53/459
3,924,383 A * 12/1975 Heger ..... 53/410
4,290,467 A * 9/1981 Schmidt ..... 383/9
4,337,058 A 6/1982 Lerner
4,566,252 A * 1/1986 Watanabe et al. ..... 53/410
RE32,963 E 6/1989 Lerner et al.
4,878,580 A * 11/1989 Johnston ..... 206/216
4,928,455 A 5/1990 Gereby et al.
4,969,310 A * 11/1990 Lerner et al. ..... 53/459
5,221,567 A * 6/1993 Baker ..... 428/43
5,341,625 A 8/1994 Kramer
5,394,676 A 3/1995 Lerner et al.

(Continued)

FOREIGN PATENT DOCUMENTS

JP 10147322 * 6/1998

*Primary Examiner*—Rinaldi I. Rada
*Assistant Examiner*—Gloria R. Weeks
(74) *Attorney, Agent, or Firm*—Calfee, Halter & Griswold LLP

(57) ABSTRACT

A method and apparatus for making packages with internal headers from an elongated web of preformed interconnected bags. The packages with internal headers are made by inserting a product or a header into a bag. The bag is sealed to form a first compartment that contains the inserted bag or header. The other of the product and the header is inserted into the bag. The bag is sealed to form a second compartment that contains other of the product or header. The package is separated from the elongated web of interconnected bags.

42 Claims, 12 Drawing Sheets

U.S. PATENT DOCUMENTS 5,540,032 A 7/1996 Sosnik et al.
5,577,369 A * 11/1996 Becker et al. ..... 53/474
5,822,949 A * 10/1998 Naoi ..... 53/55
5,873,221 A * 2/1999 Sperry et al. ..... 53/472
5,954,230 A * 9/1999 Blette et al. ..... 222/1
5,957,824 A 9/1999 Lerner et al.
5,967,308 A * 10/1999 Bowen ..... 206/219
6,035,611 A * 3/2000 Lerner ..... 53/455
6,058,681 A 5/2000 Recchia, Jr.
6,170,653 B1 * 1/2001 Panzner ..... 206/210
6,186,934 B1 2/2001 Addison
6,289,654 B1 * 9/2001 Yamaguchi et al. ..... 53/434
6,543,201 B2 4/2003 Cronauer et al.
6,823,650 B2 * 11/2004 Recchia, Jr. ..... 53/415
6,938,394 B2 * 9/2005 Perell ..... 53/412
2003/0059129 A1 * 3/2003 Sill ..... 383/9
2006/0133701 A1 * 6/2006 Daniels ..... 383/127
2007/0031069 A1 * 2/2007 Rabiea ..... 383/37

* cited by examiner

METHOD AND APPARATUS FOR MAKING PACKAGES WITH INTERNAL HEADERS FROM PREFORMED BAGS

FIELD OF THE INVENTION

The present invention relates generally to packaging and in particular to a method and apparatus for forming packages with headers by loading product and headers into preformed bags and sealing the bags.

BACKGROUND OF THE INVENTION

Various methods and apparatus for packaging articles in plastic bags are available today or have been suggested in the past. In one packaging method, the bags form part of a continuous plastic web. Each bag is connected to an adjacent bag along a line of weakness. Typically, the bags define an opening on one face through which the bag is loaded.

In early bagging machines, an operator manually loaded the product into the bag and the bag was pulled downwardly to position the next bag at the loading station. The loaded bag was then manually severed from the web.

Machines and methods for automatically loading a chain of interconnected plastic bags have been developed or have been suggested by the prior art. In general, these machines include a mechanism for sequentially feeding a lead bag to a loading station; a mechanism for expanding the mouth of the bag and maintaining it in the expanded condition during a loading operation; and, a mechanism for severing the loaded bag from the chain. If desired, the bag is sealed before severing to form a package. After the loaded bag is severed, the packaging sequence begins again with the next bag.

The individual bags are usually joined to the chain or web by a line of weakness generally formed by a plurality of perforations. After the bag is loaded, it is severed from the web along the perforations. Various mechanisms for automatically severing the loaded bag from the web have been developed or suggested.

SUMMARY

The present application relates to a method and apparatus for making packages with internal headers from an elongated web of preformed interconnected bags.

The packages with internal headers can be made from a wide variety of different types of webs of preformed interconnected bags. In one embodiment, each preformed bag is defined by first and second plies of the web. First and second side edges of the web hermetically join the first and second plies. A preformed seal extends between the first and second side edges. A line of separation in the first ply extends between the first and second side edges. A line of weakness in the second ply extends between the first and second side edges.

In one embodiment, the packages with internal headers are made by moving the first ply away from the second ply at the line of separation to form a bag opening. A product or a header is inserted into the bag through the opening. The first and second plies are sealed together to form a first compartment that contains the inserted bag or header. The other of the product and the header is inserted into the bag through the opening. The first and second plies are sealed together to form a second compartment that contains the product or header. The second ply is broken along the line of weakness to separate the package from the elongated web of interconnected bags.

Further advantages and benefits will become apparent to those skilled in the art after considering the following description and appended claims in conjunction with the accompanying drawings.

DETAILED DESCRIPTION

Figure 1A:
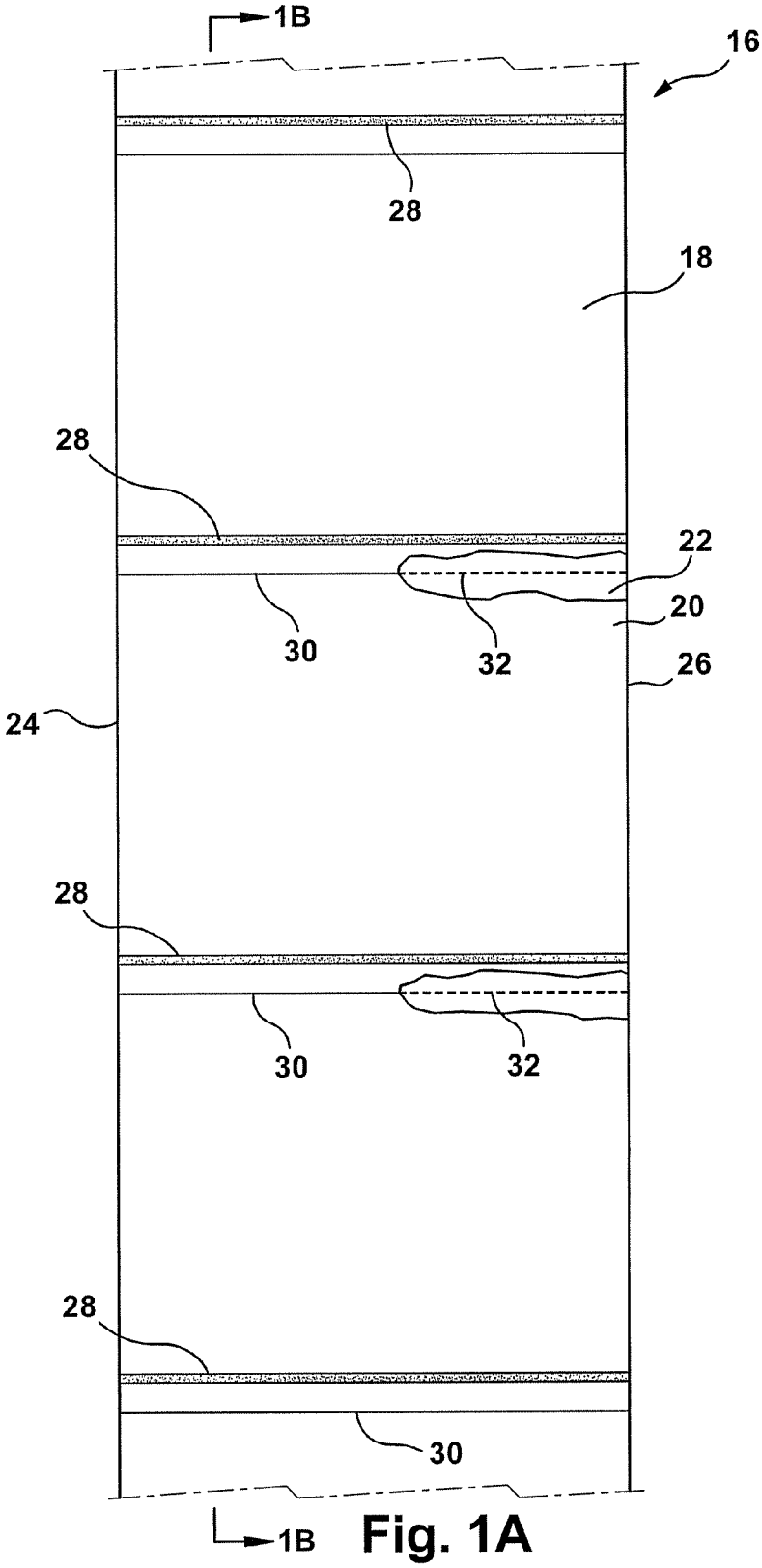
FIG. 1A is a schematic illustration of an exemplary elongated web of preformed interconnected bags.

The present application relates to a method and apparatus 10 for making packages 12 with internal headers 14 from an elongated web 16 of preformed interconnected bags 18.

Figure 1B:
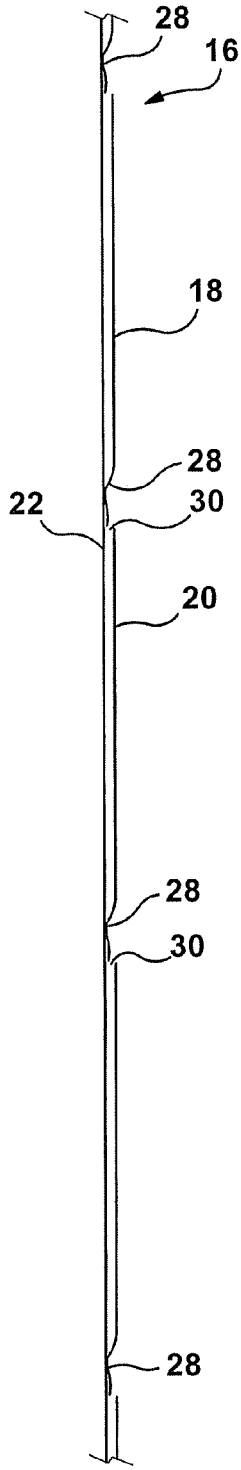
FIG. 1B is a view of the elongated web taken along lines 1B-1B in FIG. 1A.

The packages 12 with internal headers 14 can be made from a wide variety of different types of webs 16 of preformed interconnected bags 18. In the example illustrated by FIGS. 1A and 1B, each preformed bag 18 is defined by first and second plies 20, 22 of the web 16. First and second side edges 24, 26 of the web hermetically join the first and second plies. Preformed seals 28 extends between the first and second side edges 24, 26. A line of separation 30, such as a cut in the first ply extends between the first and second side edges 24, 26. A line of weakness 32, such as a line of perforations in the second ply extends between the first and second side edges 24, 26. The web 16 of preformed bags 18 illustrated by FIGS. 1A and 1B is one example of the wide variety of different webs that may be used. Examples of acceptable webs of preformed interconnected bags include, but are not limited to, the webs disclosed in U.S. Pat. No. 3,254,828 to H. Lerner and U.S. Pat. No. 5,957,824 to B. Lerner et al., which are incorporated herein by reference in their entirety.

The web may be formed of any suitable material. Examples of suitable materials include, but are not limited to, plastic materials, polyethylene, cellophane, vinyl films, pliofilms, cellulose acetate film, polystyrene, polypropylene, and any heat sealable material.

Figure 3:
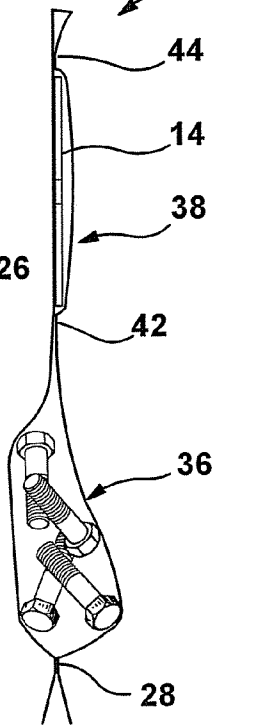
FIG. 3 is a view of the package taken along lines 3-3 in FIG. 2.
Figure 2:
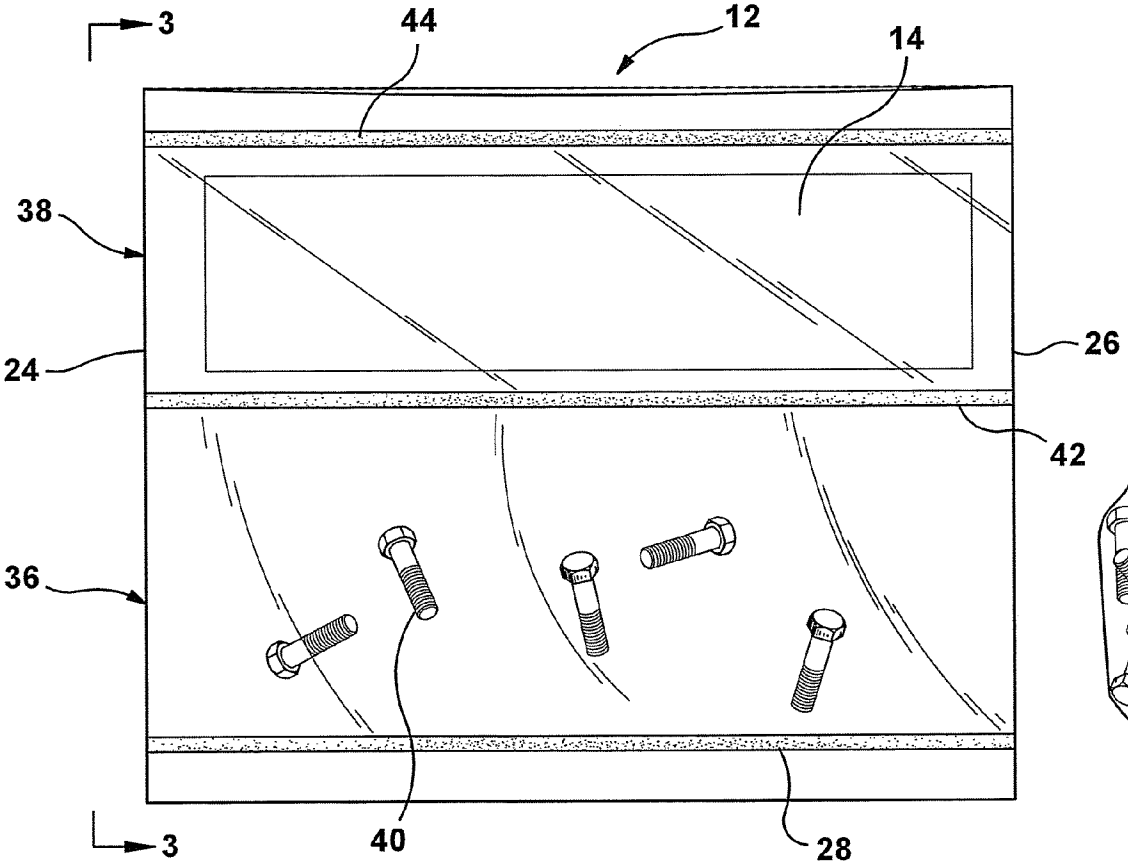
FIG. 2 is a view of an exemplary package with an internal header.

FIGS. 2 and 3 illustrate an example of a package 12 with an internal header 14. The package 12 illustrated by FIGS. 2 and 3 includes first and second compartments 36, 38. The package 12 may have any number of compartments. Product 40 is disposed in the first compartment 36 and the header 14 is disposed in the second compartment 38. The illustrated product 40 is a plurality of bolts. However, the package 12 may contain any product. It should be apparent that the product can be in the second compartment and the header can be in the first compartment. The first compartment is defined by the first and second side edges 24, 26, the preformed seal 28, and a dividing seal 42. In the example, the dividing seal 42 extends from the first side edge 24 to the second side edge 26 to hermetically seal the first compartment 36. In another embodiment, the dividing seal 28 may not extend all the way from the first side edge to the second side edge or may be intermittent to allow communication between the first and second compartments. The second compartment is defined by the first and second side edges 24, 26, the dividing seal 42, and a header seal 44. In the example, the header seal extends from the first side edge 24 to the second side edge 26. In another embodiment, the header seal may not extend all the way from the first side edge to the second side edge or may be intermittent.

FIGS. 4-23 schematically illustrate an example of an apparatus 10 for making packages 12 with internal headers 14 from an elongated web 16 of preformed interconnected bags 18. The concept of the apparatus 10 can be implemented in any of a wide variety of packaging machines. For example, U.S. Pat. No. 3,254,468 to H. Lerner, U.S. Pat. No. 4,928,455 to Gereby et al., U.S. Pat. No. 5,341,625 to Kramer, U.S. Pat. No. 5,394,676 to B. Lerner et al., and U.S. Pat. No. 6,543,201 to Cronauer et al. disclose packaging machines that can be modified in accordance with the present invention to make packages with internal headers from an elongated web of preformed interconnected bags and are all incorporated herein by reference in their entirety.

Figure 4:
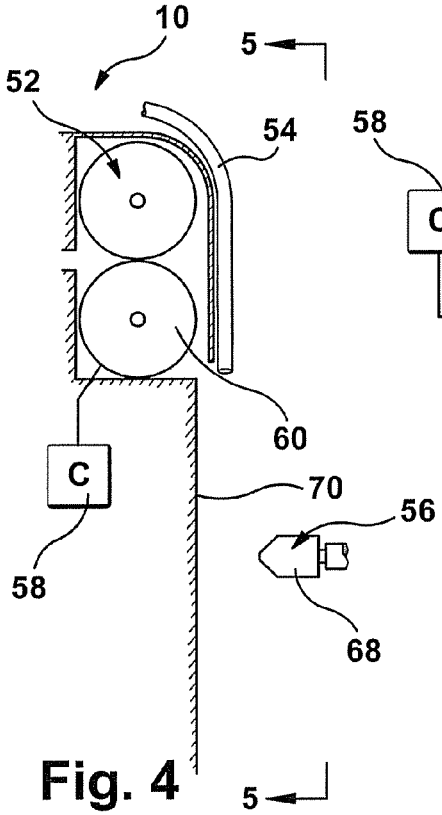
FIG. 4 is a schematic illustration of an exemplary apparatus for making packages with an internal header from an elongated web of preformed interconnected bags.
Figure 5:
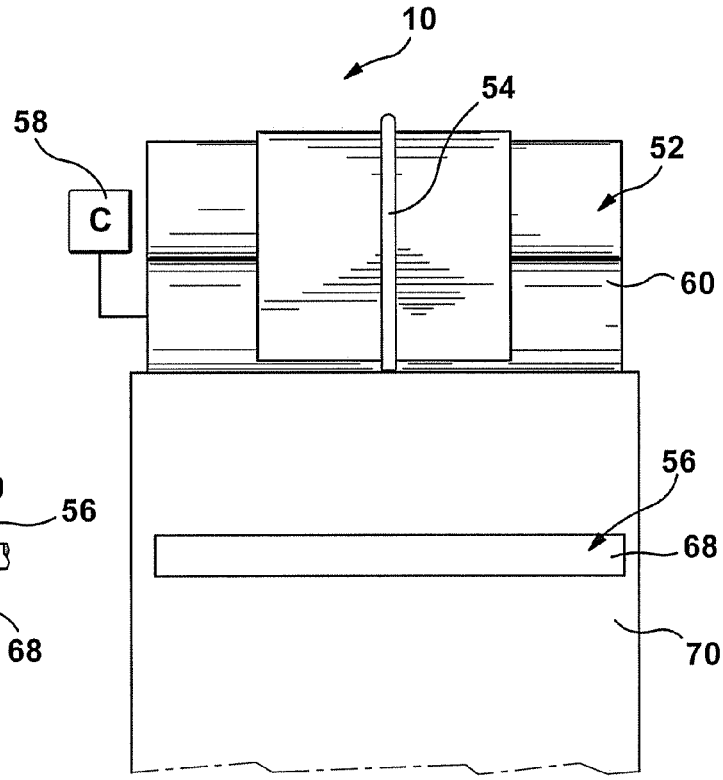
FIG. 5 is a view of the apparatus taken along lines 5-5 in FIG. 4.

Referring now to FIGS. 4 and 5, the illustrated apparatus 10 includes a supply 50 of the elongated web 16 of preformed interconnected bags 18, an indexing mechanism 52, an opening arrangement 54, a sealing arrangement 56, and a controller 58. The supply 50 comprises the elongated web 16 rolled or folded to stage a relatively large amount of the web in a relatively small space.

Referring to FIGS. 4 and 5, the web 16 is routed from supply 50 along a path of travel P to the indexing mechanism 52. The indexing mechanism 52 receives the web 16 from the supply and moves the web along the path of travel P. The indexing mechanism 52 may take a wide variety of different forms. For example, any indexing mechanism that can be controlled to index bags of the web to selected positions along the path of travel may be used. In the illustrated example, the indexing mechanism comprises a pair of rollers 60 that form a nip that engages the web 16. The rollers 60 are selectively driven by a motor (not shown) to index bags of the web to selected positions along the path of travel P.

Referring to FIGS. 4 and 5, the opening arrangement 54 is positioned along the path of travel P to open each bag that is indexed to the opening arrangement. In the illustrated embodiment, the opening arrangement 54 moves the first ply 20 away from the second ply 22 at the line of separation 30 to form a bag opening 62 (see FIGS. 6 and 7). The opening arrangement 54 may take a wide variety of different forms. For example, any mechanism that moves the first and second plies 20, 22 apart to form a bag opening may be implemented. In the illustrated embodiment, the opening arrangement 54 comprises a blower. When the line of separation 30 is positioned near the blower by the indexing mechanism 52, air is forced between the plies through the line of separation. The bag is inflated by the blower to open the bag.

Referring to FIGS. 4 and 5, the sealing arrangement 56 is positioned along the path of travel P to provide the dividing seal 42 and the header seal 44. The sealing arrangement 56 may take a wide variety of different forms. For example, any mechanism that applies heat to the web to seal the first and second webs together to form the dividing seal and the header seal 44 may be implemented. In the illustrated embodiment, the sealing arrangement comprises a heated bar 68 that is selectively moved into and out of engagement with a base member 70. When the heated bar 68 is in engagement with the base member 70, the web is clamped between the heated bar 68 and the base member 70. Heat is applied to the web to seal the plies of the web together between the first side edge 24 and the second side edge 26.

Referring to FIGS. 4 and 5, the controller 58 is in communication with the indexing arrangement 52, the opening arrangement 54, and the sealing arrangement 56. The controller 58 controls the indexing arrangement 52, the opening arrangement 54, and the sealing arrangement 56 to convert the preformed bags 18 into packages 12 with internal headers. A wide variety of controllers can be used and programmed to control the indexing arrangement 52, the opening arrangement 54, and the sealing arrangement 56 as described herein. For example, the controller and controller algorithms described in U.S. Pat. No. 5,341,625 to Kramer can be modified to control the indexing arrangement 52, the opening arrangement 54, and the sealing arrangement 56 to perform the method of forming packages with internal headers as described herein.

FIGS. 6-23 illustrate use of the apparatus 10 to perform a method of making packages 12 with internal headers 14. The packages 12 with internal headers 14 are made by moving the first ply 20 away from the second ply 22 at the line of separation 30 to form a bag opening 62. A product 40 or a header 14 is inserted into the bag through the opening. In one embodiment the header 14 is inserted first. In another embodiment, the product 40 is inserted first. The first and second plies 20, 22 are sealed together to form the first compartment 36. The other of the product 40 and the header 14 is then inserted into the bag 18 through the opening 62. The first and second plies 20, 22 are sealed together to form the second compartment 38. The second ply 22 is broken along the line of weakness 32 to separate the package 12 from the elongated web 16 of interconnected bags 18.

Figure 6:
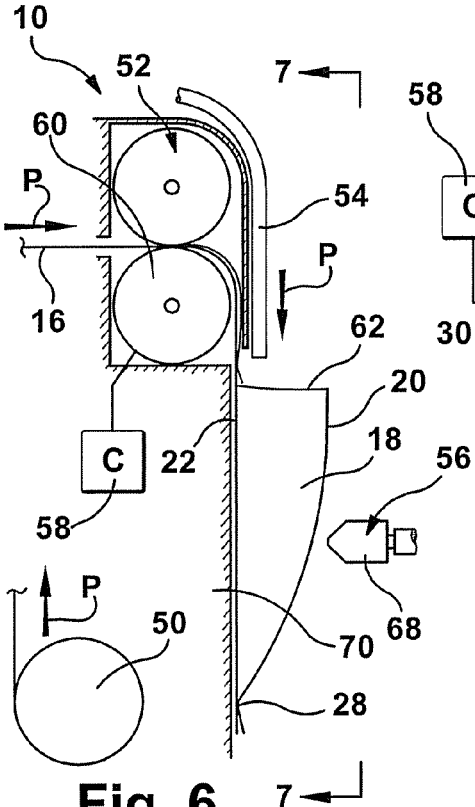
FIG. 6 is a schematic illustration of the apparatus with a bag positioned for loading.
Figure 7:
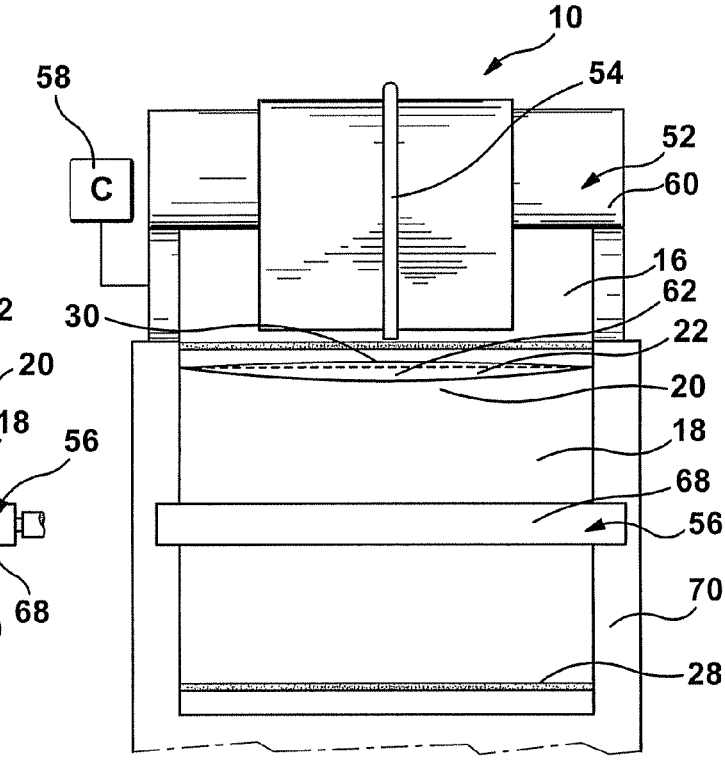
FIG. 7 is a view of the apparatus taken along lines 7-7 in FIG. 6.
Figure 8:
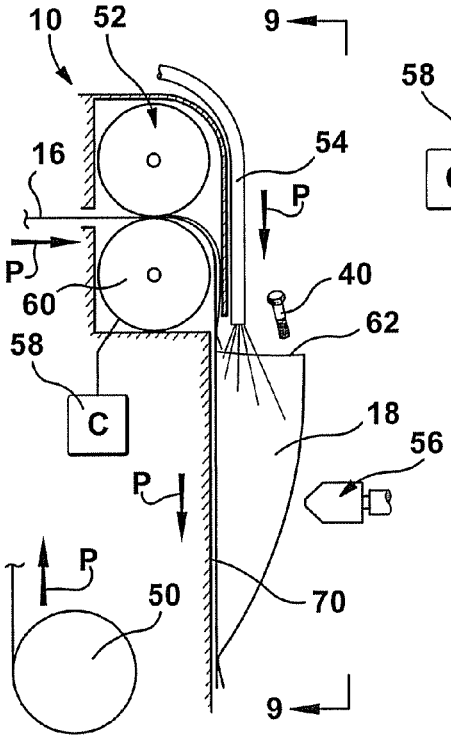
FIG. 8 is a schematic illustration of the apparatus with the bag being loaded with a product.
Figure 9:
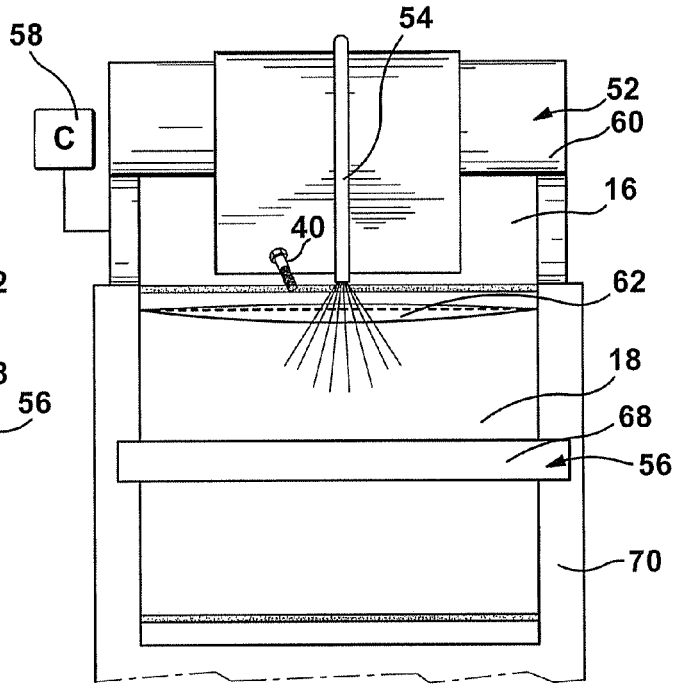
FIG. 9 is a view of the apparatus taken along lines 9-9 in FIG. 8.
Figure 10:
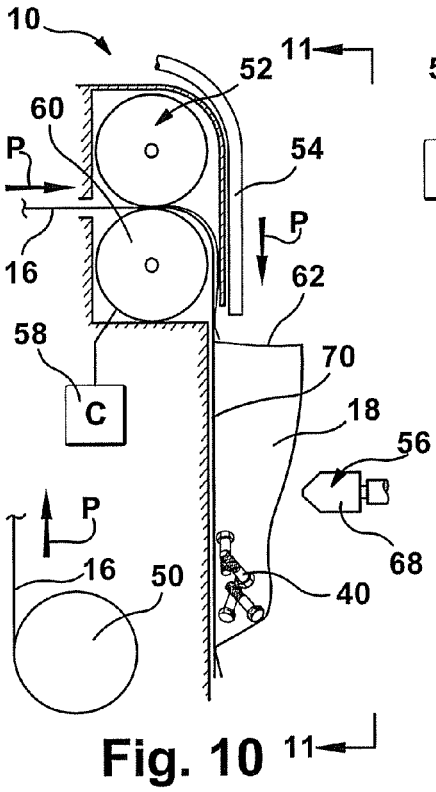
FIG. 10 is a schematic illustration of the apparatus with the bag loaded with product.
Figure 11:
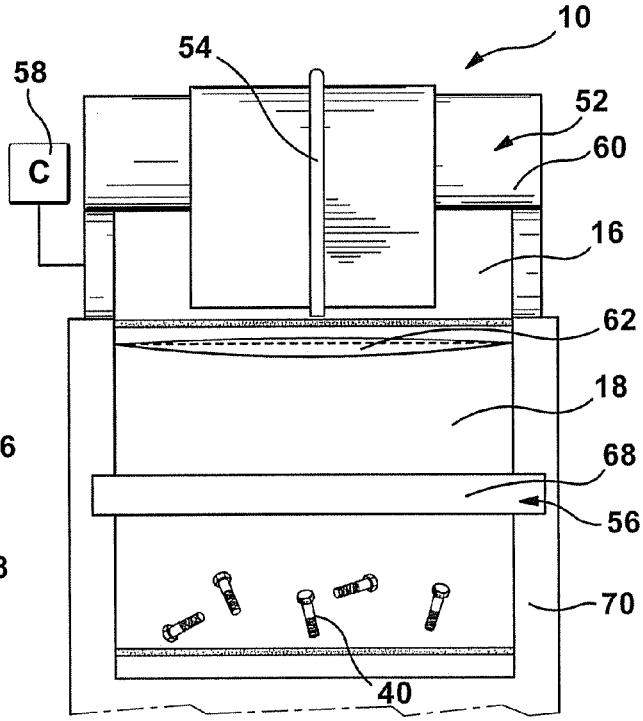
FIG. 11 is a view of the apparatus taken along lines 11-11 in FIG. 10.
Figure 12:
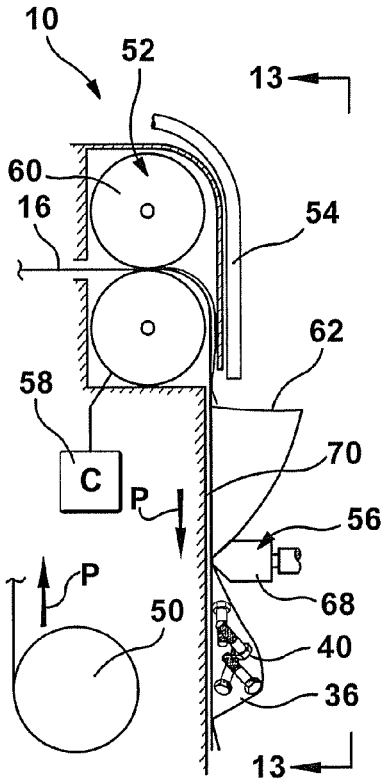
FIG. 12 is a schematic illustration of the apparatus with the bag being sealed to enclose the product in the package.
Figure 13:
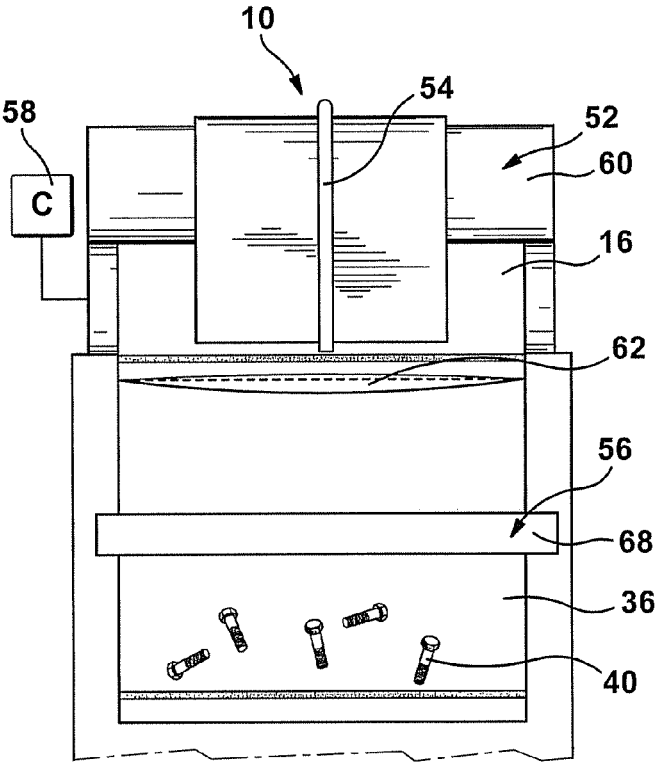
FIG. 13 is a view of the apparatus taken along lines 13-13 in FIG. 12.
Figure 14:
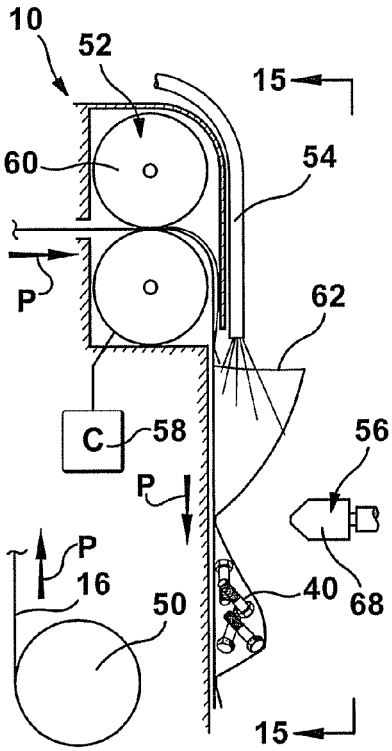
FIG. 14 is a schematic illustration of the apparatus with the bag sealed with the product enclosed in the package.
Figure 15:
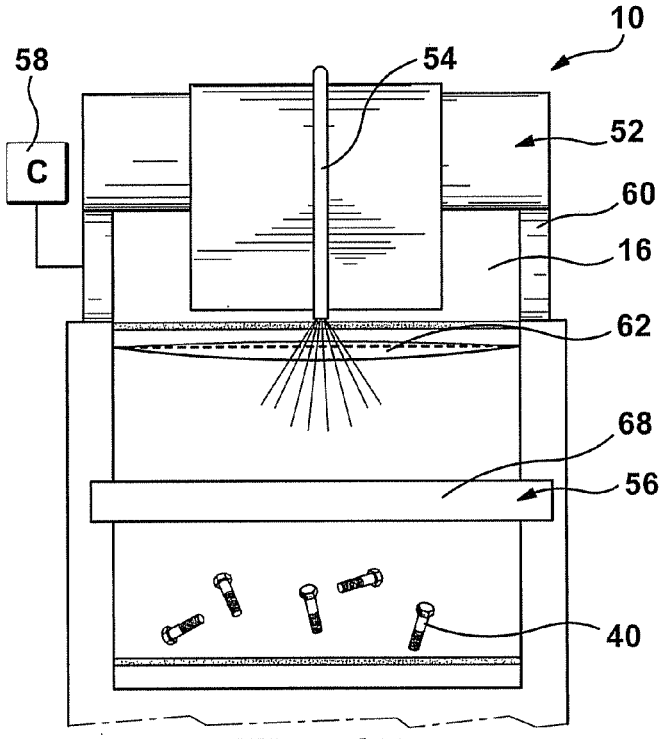
FIG. 15 is a view of the apparatus taken along lines 15-15 in FIG. 14.

Referring to FIGS. 6 and 7, the controller 58 controls the indexing arrangement 52 to position the a bag 18 of the web 16 at a bag opening position. The controller 58 controls the opening arrangement 54 to open the bag 18 at the bag opening position. Referring to FIGS. 8-11, product 40 is inserted into the opened bag.

Referring to FIGS. 12-15, the controller 58 controls the sealing arrangement 56 to seal the first and second plies 20, 22 together to form the first compartment 36 that contains the product. The controller 58 may also control the indexing arrangement 52 to position the bag 18 with respect to sealing arrangement 56 before the dividing seal 42 is formed to apply the dividing seal at a selected position on the package. In another embodiment, the position of the sealing arrangement 56 is adjustable and controlled by the controlled by the controller 58. In this embodiment, the controller may control the position of the sealing arrangement 56 to apply the dividing seal 42 at the selected position on the package.

Figure 16:
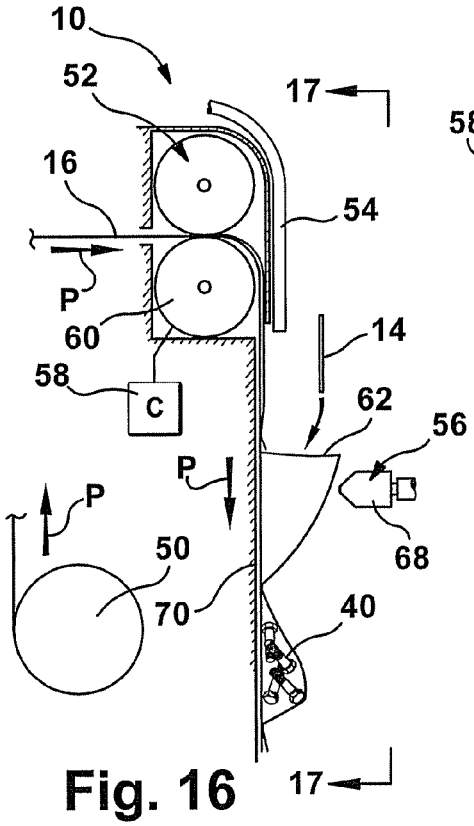
FIG. 16 is a schematic illustration of the apparatus with the bag being loaded with an exemplary header.
Figure 17:
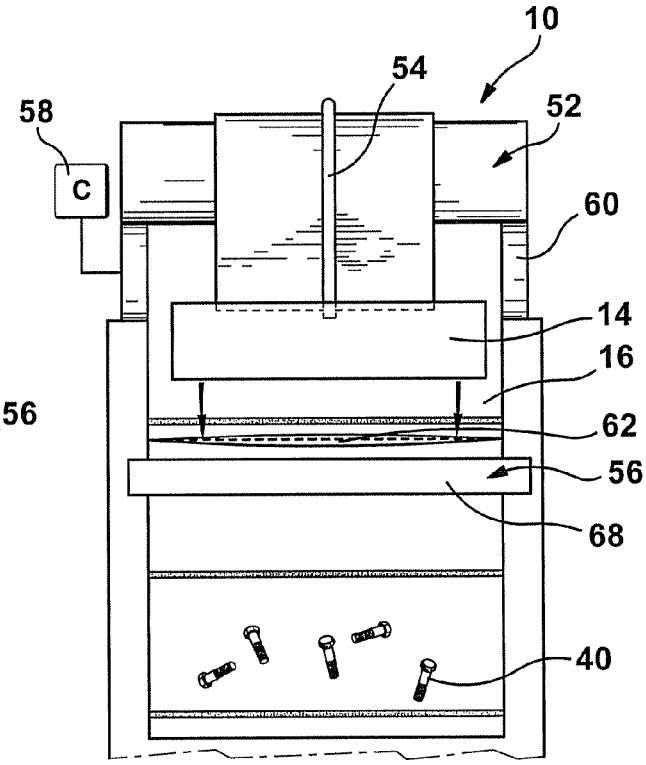
FIG. 17 is a view of the apparatus taken along lines 17-17 in FIG. 16.

Once the dividing seal 42 is formed, the controller 58 may cause the opening arrangement 54 to expand the opening 62 of the bag 18 again for insertion of the header 14 or the bag may remain open from the initial opening operation. The controller 58 may also control the indexing arrangement 52 to position the bag 18 for insertion of the header. In the illustrated embodiment, the position of the bag 18 for insertion of the header is the same as the position for insertion of the product. Referring to FIGS. 16 and 17, the header 14 is inserted into the opened bag.

Figure 18:
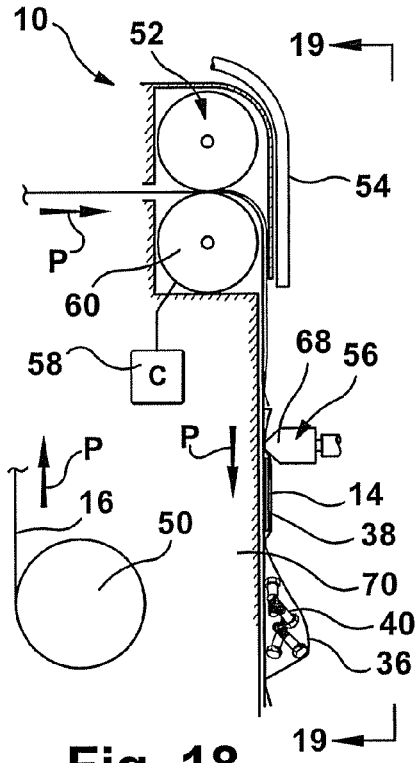
FIG. 18 is a schematic illustration of the apparatus with the bag being sealed to enclose the header in the package.
Figure 19:
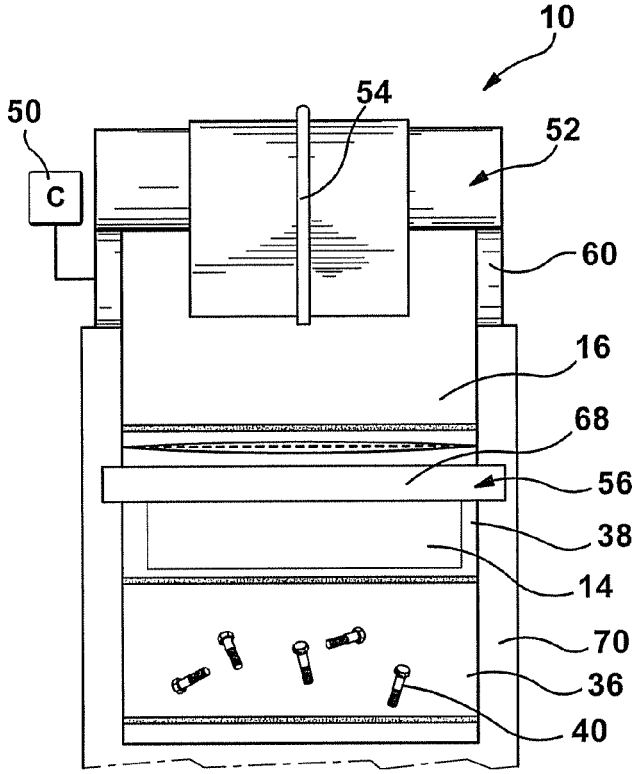
FIG. 19 is a view of the apparatus taken along lines 19-19 in FIG. 18.

Referring to FIGS. 18 and 19, the controller 58 controls the indexing arrangement 52 to position the bag 18 with respect to sealing arrangement 56 to set the position of the header seal 44 on the package. The indexing arrangement may have to move the bag 18 toward or away from the indexing arrangement 52 to set the position of the header seal. The controller 58 controls the sealing arrangement 56 to seal the first and second plies 20, 22 together to form the second compartment 38 that contains the header.

Figure 20:
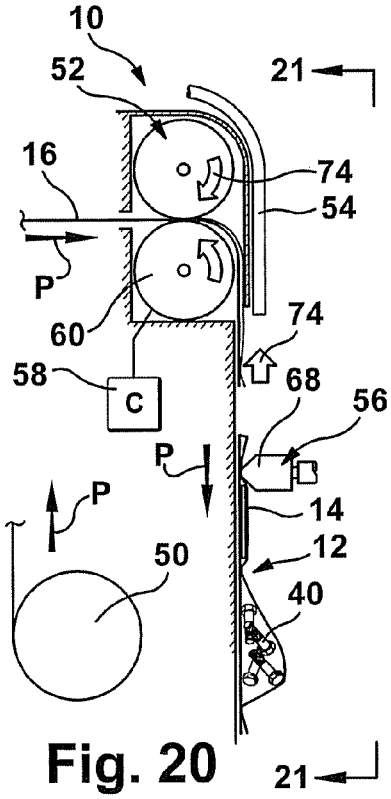
FIG. 20 is a schematic illustration of the apparatus pulling the web away from the leaded bag to separate the loaded bag from the web.
Figure 21:
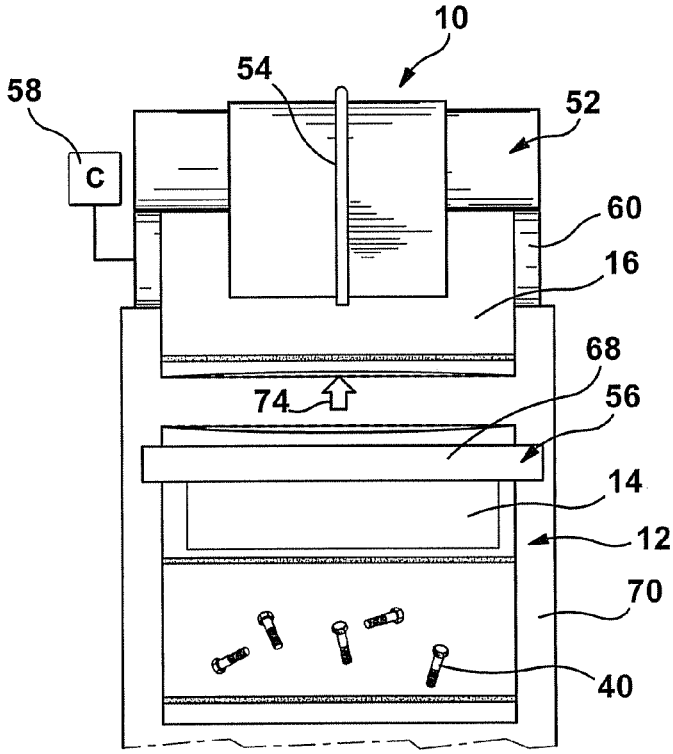
FIG. 21 is a view of the apparatus taken along lines 21-21 in FIG. 20.
Figure 22:
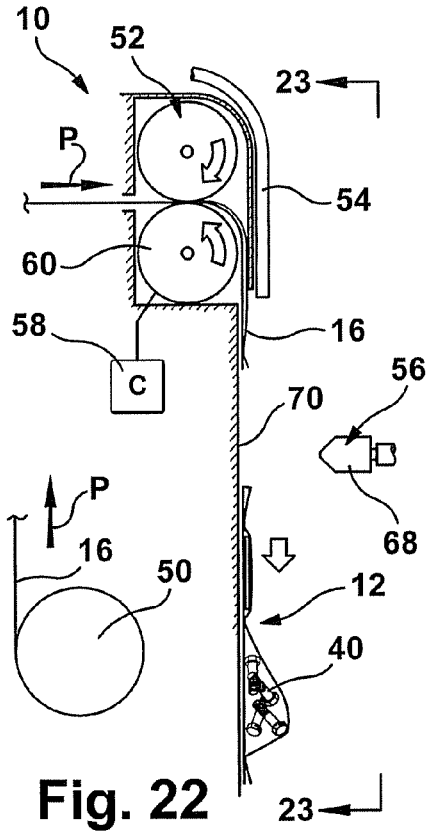
FIG. 22 is a schematic illustration of the apparatus releasing an exemplary package with an internal header.
Figure 23:
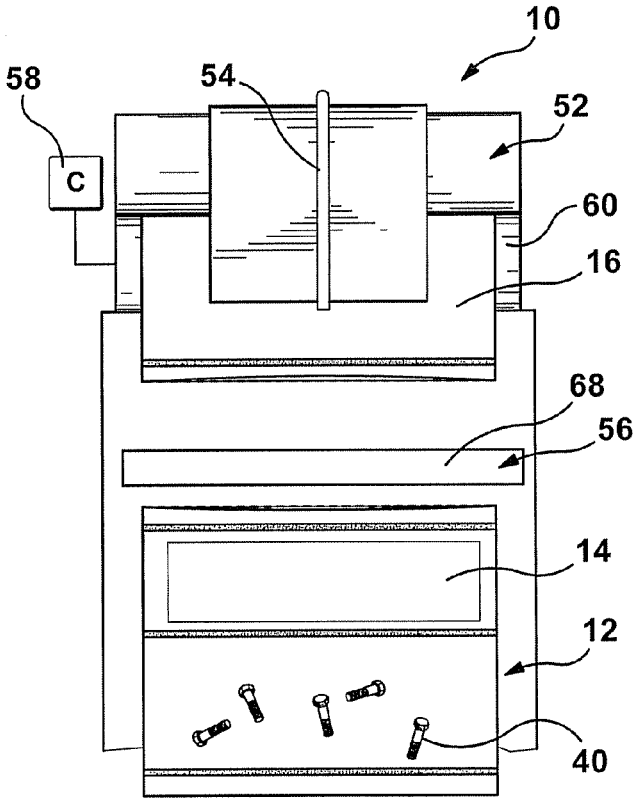
FIG. 23 is a view of the apparatus taken along lines 23-23 in FIG. 22.

Referring to FIGS. 20 and 21, the controller 58 controls the indexing arrangement 52 to pull the web 16 away from the bag 18 as indicated by arrows 74 while the bag is clamped by the sealing arrangement 56. The bag 18 breaks free of the web 16 along the line of weakness 32. In one embodiment, the sealing arrangement 56 includes a trimming device 71 (see FIGS. 35-38), such as a sharp edge, that cuts off excess material between the header seal 44 and the end of the bag 18 after the bag has been separated from the web. Referring to FIGS. 22 and 23, the controller 58 controls the sealing arrangement 56 to release the formed package 12 with internal header 14. The controller may repeat the method as required to produce additional packages from the web of bags.

Figure 26:
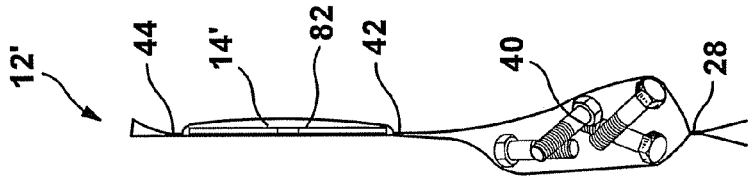
FIG. 26 is a view of the package taken along lines 26-26 in FIG. 25.
Figure 25:
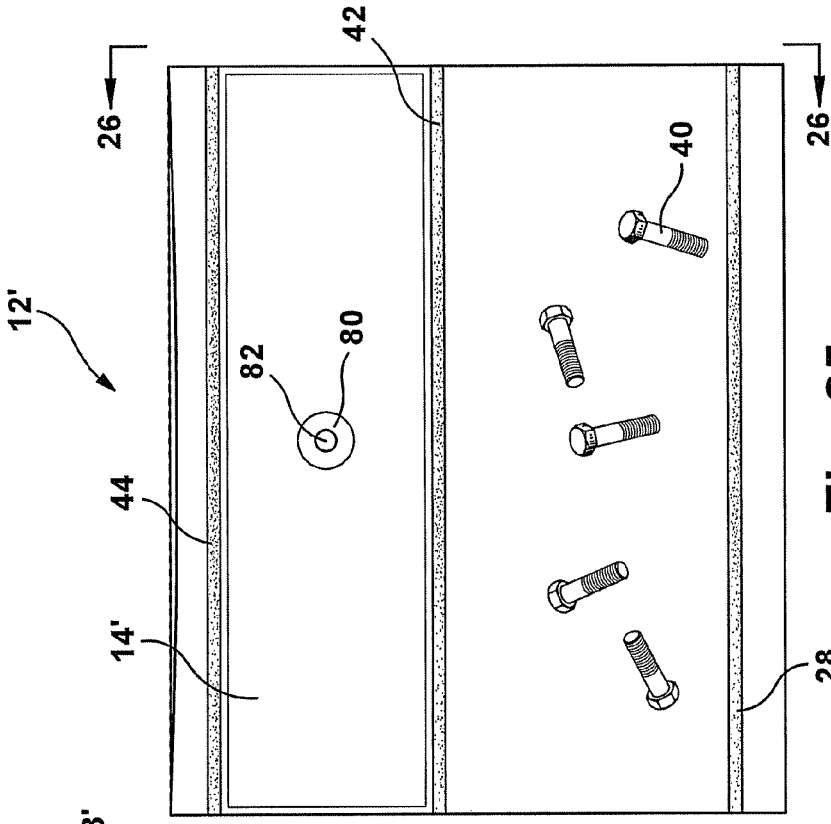
FIG. 25 is a view of an exemplary package with an internal header with a support opening.
Figure 24:
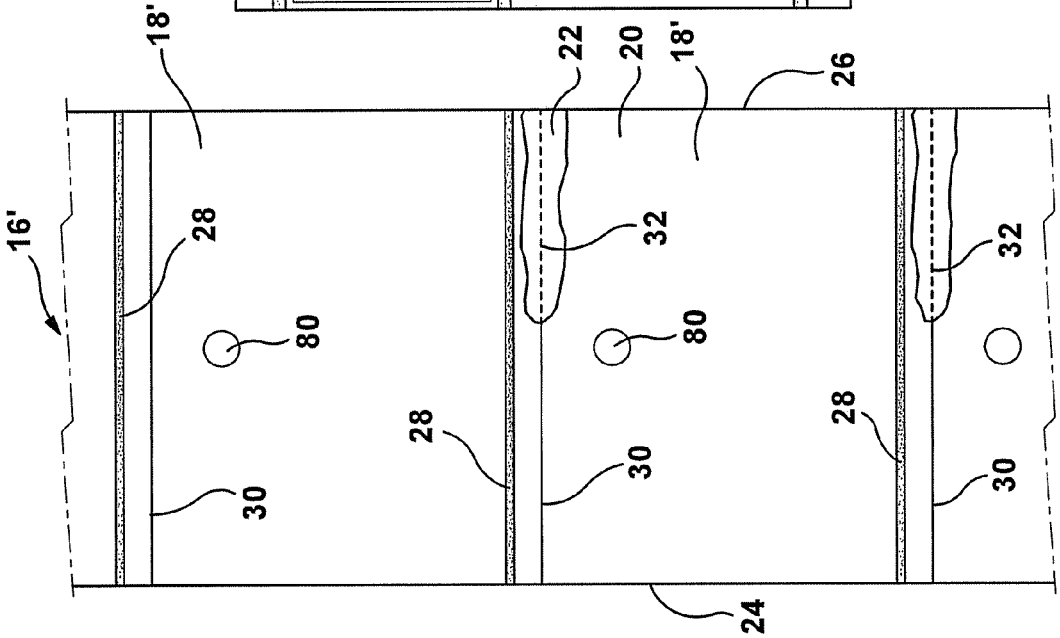
FIG. 24 is a schematic illustration of an exemplary elongated web of preformed interconnected bags with preformed header openings that correspond to support openings in headers.

FIG. 24 is a schematic illustration of another embodiment of a elongated web 16' of preformed interconnected bags 18'. The web 16' is substantially the same as the web 16 illustrated in FIG. 1, except each bag 18' includes a preformed opening 80 or hole through the first and second plies. In another embodiment, the web illustrated by FIG. 1 is used and the apparatus includes a punch that punches the hole 80 in the web 16. FIGS. 25 and 26 are schematic illustrations of another embodiment of a package 12' with an enclosed header 14'. The packages 12' are substantially the same as the packages 12 illustrated by FIGS. 2 and 3, except the headers 14' include support openings 82. The preformed openings 80 correspond to support openings 82 in headers 14'. The openings 80, 82 allow the packages 12' to be mounted for display on a rod or hook that extends through the support openings 82. In another embodiment, the web 16 and headers 14 illustrated by FIGS. 1-3 is used and the apparatus includes a punch that punches holes through the web 16 and the header.

Figure 27:
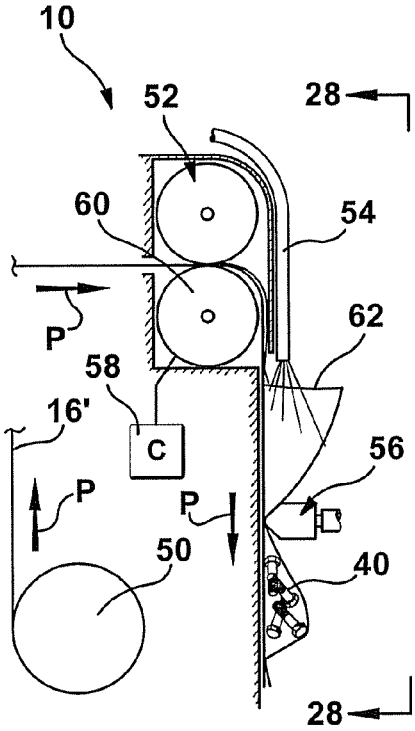
FIG. 27 is a schematic illustration of the apparatus with the bag with a preformed opening being sealed to enclose the product in the package.
Figure 28:
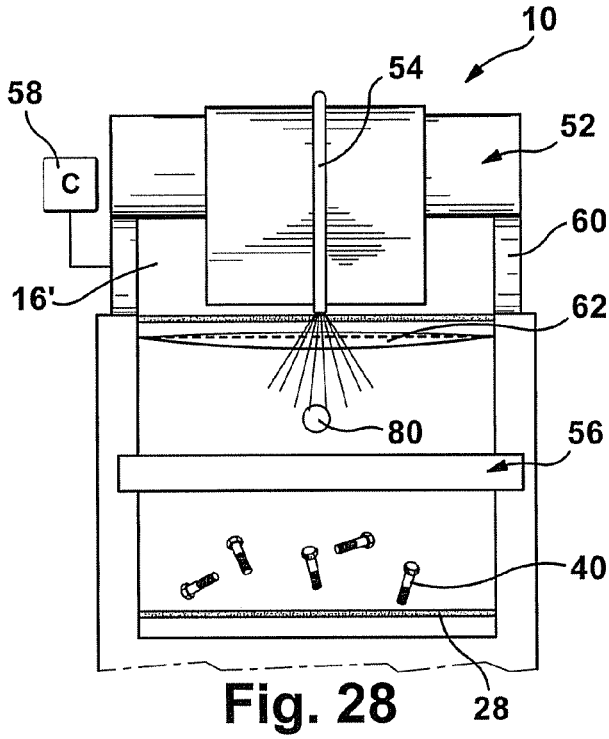
FIG. 28 is a view of the apparatus taken along lines 28-28 in FIG. 27.
Figure 29:
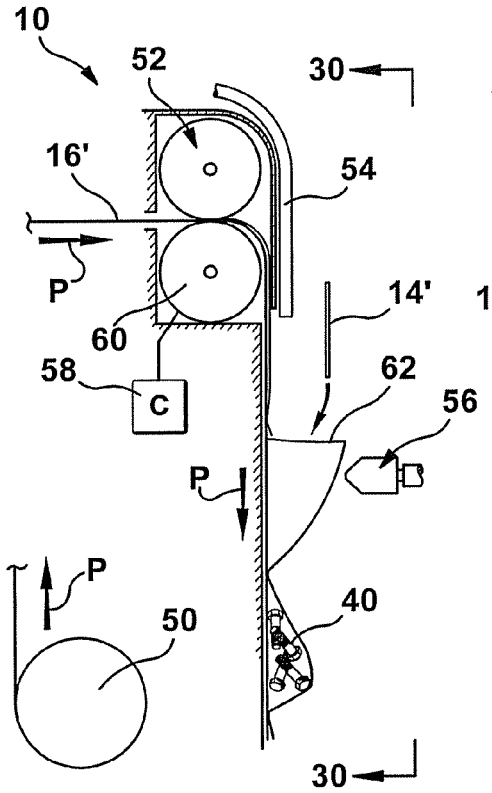
FIG. 29 is a schematic illustration of the apparatus with the bag being loaded with an exemplary header with a support opening.
Figure 30:
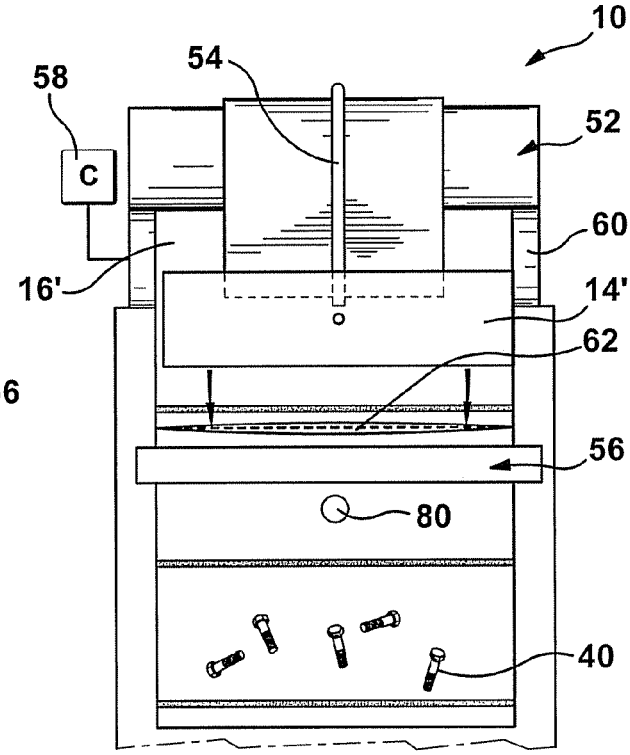
FIG. 30 is a view of the apparatus taken along lines 30-30 in FIG. 29.
Figure 31:
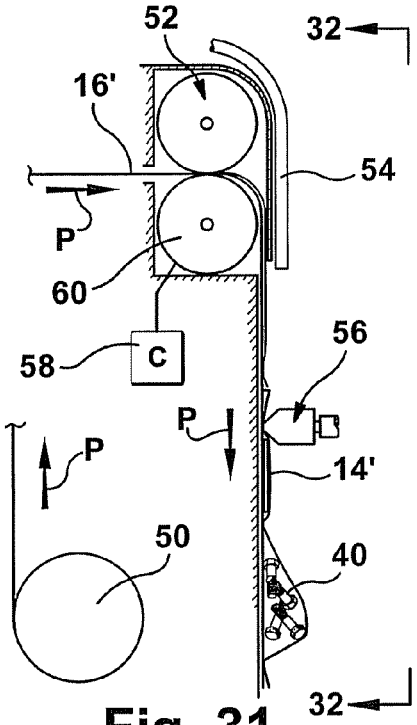
FIG. 31 is a schematic illustration of the apparatus with the bag with a preformed opening being sealed to enclose the header in the package.
Figure 32:
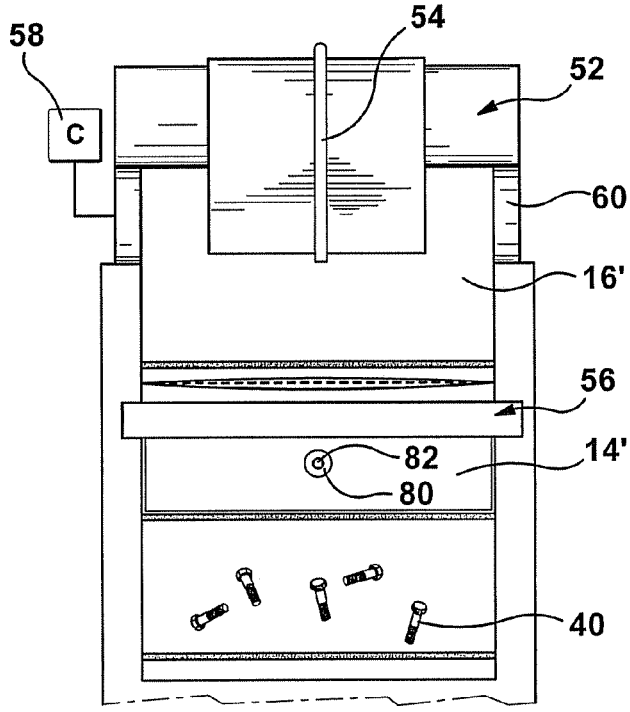
FIG. 32 is a view of the apparatus taken along lines 32-32 in FIG. 31.
Figure 33:
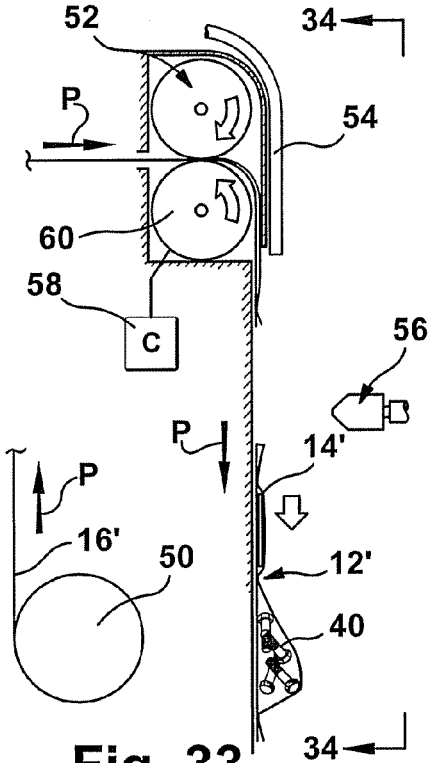
FIG. 33 is a schematic illustration of the apparatus releasing an exemplary package with an internal header.
Figure 34:
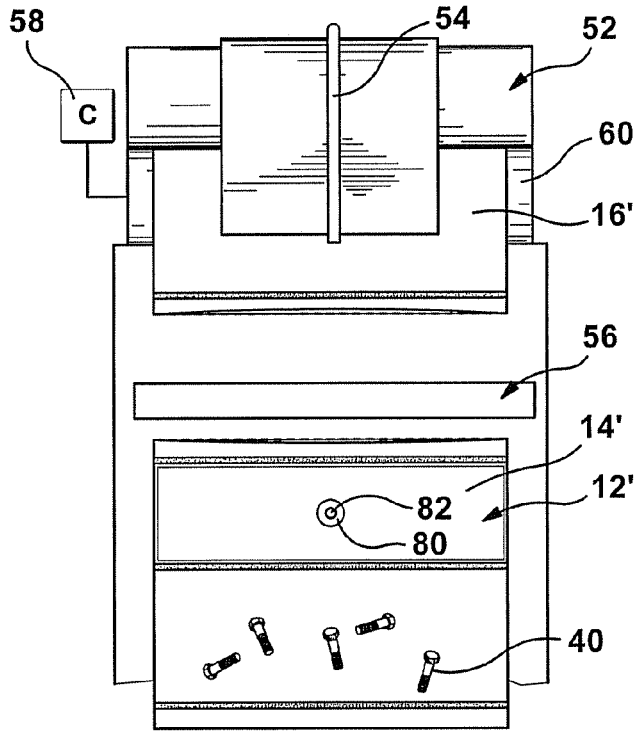
FIG. 34 is a view of the apparatus taken along lines 34-34 in FIG. 33.

FIGS. 27-36 illustrate operation of the apparatus 10 to perform a method of making packages 12' with internal headers 14' that include a support opening 82. Referring to FIGS. 27 and 28, a bag 18' of the web 16' is positioned at a bag opening position. The bag 18' is opened at the bag opening position and product 40 is inserted into the opened bag. The sealing arrangement 56 form the first compartment 36 around the product. Referring to FIGS. 29 and 30 the header 14' is then inserted into the opened bag. Referring to FIGS. 31 and 32, the indexing arrangement 52 positions the bag 18' with respect to sealing arrangement 56 to set the position of the header seal 44 on the package. The sealing arrangement 56 seals the first and second plies 20, 22 together to form the second compartment 38 that contains the header 14'. Referring to FIGS. 33 and 34, the indexing arrangement 52 pulls the web 16' away from the bag 18' as indicated by arrows 74 and the sealing arrangement 56 releases the formed package 12' with internal header 14' that includes a support opening 82.

The products 40 and the headers 14 can be inserted into the bags 18 in a wide variety of different ways. For example, the products 40 and/or the headers 14 can be loaded into the bags manually or the products and/or can be loaded into the bags 18 using a wide variety of different loading mechanisms. FIGS. 35-38 illustrate an embodiment of the apparatus 10 that includes a product loading mechanism 90 and a header loading mechanism 92. The product loading mechanism 90 is positioned along the path of travel for loading product 40 into the bag opening. The product loading mechanism is illustrated as a chute, but can be any structure that directs products 40 into the bag 18. In the exemplary embodiment, the product loading mechanism 90 is controlled by the controller 58 to load the product into the bags. The header loading mechanism 92 is positioned along the path of travel for loading headers 14 into the bag opening. The header loading mechanism 92 is schematically illustrated and can be any structure that directs products 40 into the bag 18. In the exemplary embodiment, the header loading mechanism 92 is controlled by the controller 58 to load the headers into the bags.

Figure 36:
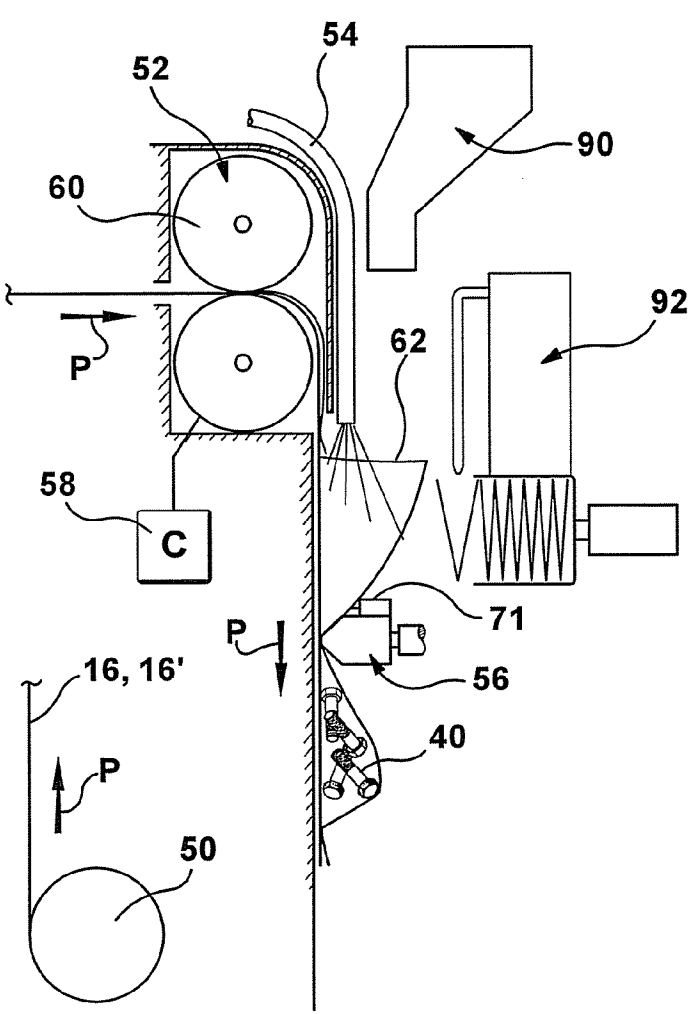
FIG. 36 is a schematic illustration of an exemplary apparatus for making packages with an internal headers from an elongated web of preformed interconnected bags that includes product and header loading mechanisms with a sealing arrangement sealing the product in the bag.
Figure 35:
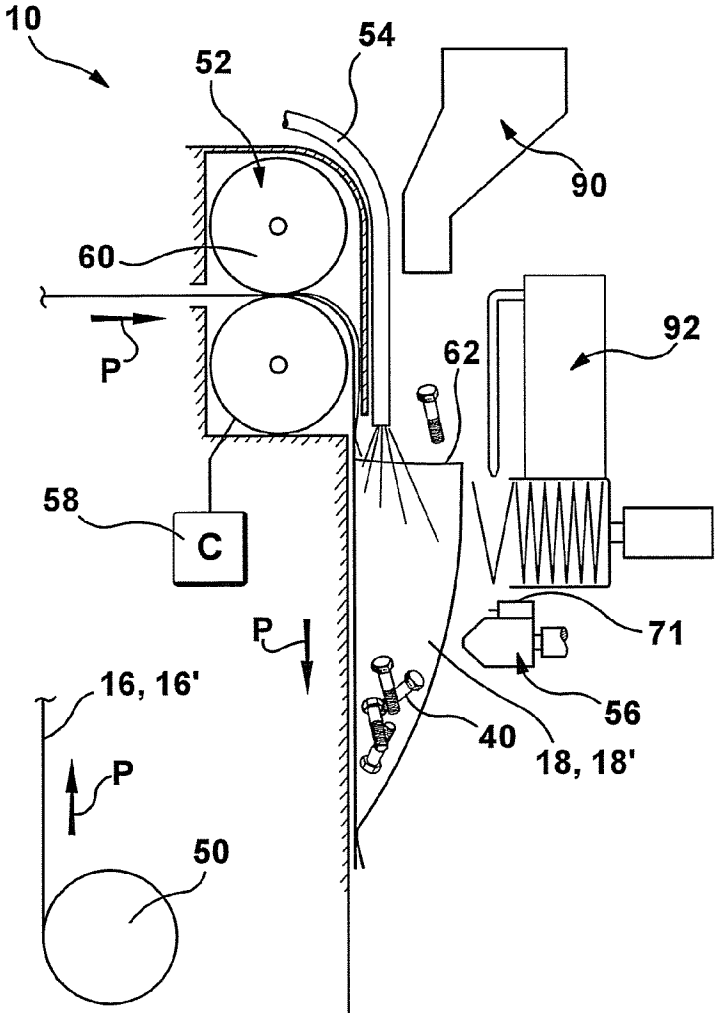
FIG. 35 is a schematic illustration of an exemplary apparatus for making packages with an internal headers from an elongated web of preformed interconnected bags that includes product and header loading mechanisms with the product loading mechanism loading product into a bag.
Figure 38:
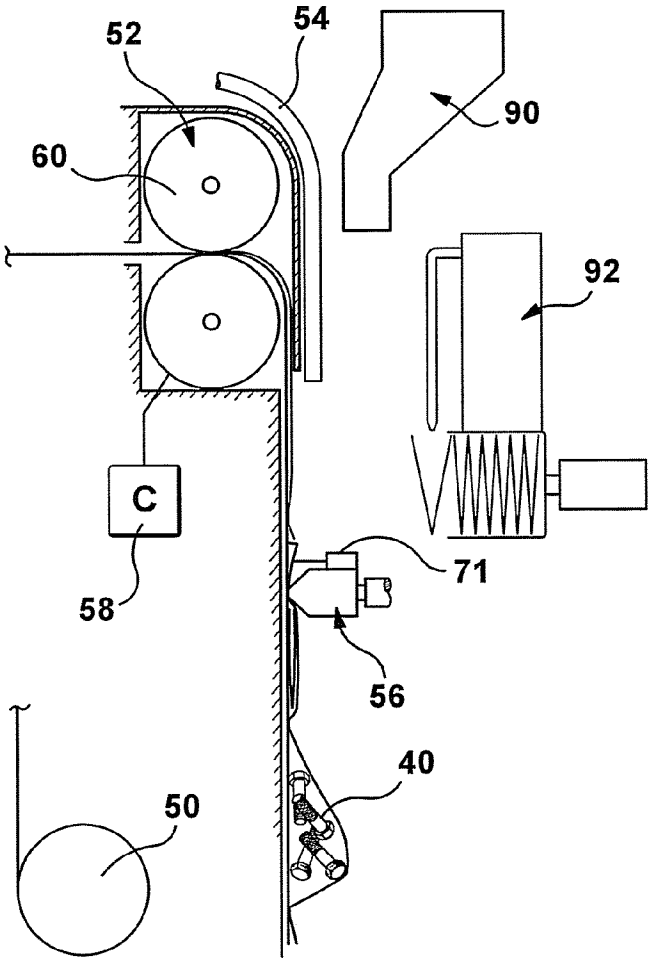
FIG. 38 is a schematic illustration of an exemplary apparatus for making packages with an internal headers from an elongated web of preformed interconnected bags that includes product and header loading mechanisms with a sealing arrangement sealing the header in the bag.
Figure 37:
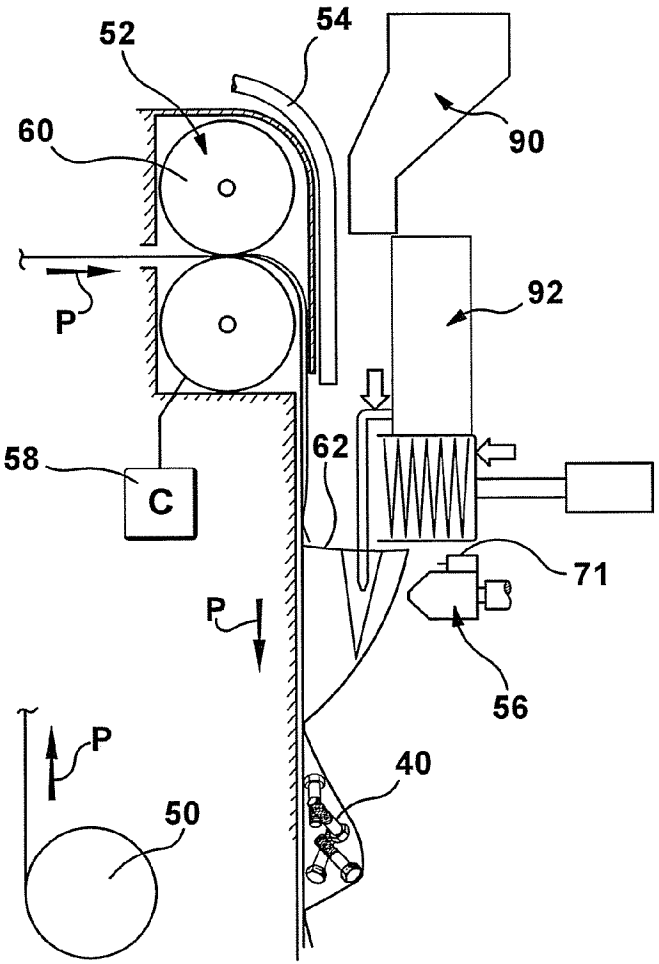
FIG. 37 is a schematic illustration of an exemplary apparatus for making packages with an internal headers from an elongated web of preformed interconnected bags that includes product and header loading mechanisms with the header loading mechanism loading a header into a bag.

Referring to FIG. 35, a bag 18, 18' of the web 16, 16' is positioned at a bag opening position. The bag 18, 18' is opened at the bag opening position. The controller 58 controls the product loading mechanism 90 to load product 40 into the opened bag. Referring to FIG. 36, the sealing arrangement 56 forms the first compartment 36 around the product. Referring to FIG. 37, the controller 58 controls the header loading mechanism 92 to insert the header 14, 14' into the opened bag. Referring to FIG. 38, the sealing arrangement 56 seals the first and second plies 20, 22 together to form the second compartment 38 that contains the header 14, 14'.

It should be understood that the embodiments discussed above are representative of aspects of the invention and are provided as examples and not an exhaustive description of implementations of an aspect of the invention.

While various aspects of the invention are described and illustrated herein as embodied in combination in the exemplary embodiments, these various aspects may be realized in many alternative embodiments, either individually or in various combinations and sub-combinations thereof. Unless expressly excluded herein all such combinations and sub-combinations are intended to be within the scope of the present invention. Still further, while various alternative embodiments as to the various aspects and features of the invention, such as alternative materials, structures, configurations, methods, devices, software, hardware, control logic and so on may be described herein, such descriptions are not intended to be a complete or exhaustive list of available alternative embodiments, whether presently known or later developed. Those skilled in the art may readily adopt one or more of the aspects, concepts or features of the invention into additional embodiments within the scope of the present invention even if such embodiments are not expressly disclosed herein. Additionally, even though some features, concepts or aspects of the invention may be described herein as being a preferred arrangement or method, such description is not intended to suggest that such feature is required or necessary unless expressly so stated. Still further, exemplary or representative values and ranges may be included to assist in understanding the present invention however, such values and ranges are not to be construed in a limiting sense and are intended to be critical values or ranges only if so expressly stated.

The invention claimed is:

1. A method of making packages with an internal header from an elongated web of preformed interconnected bags, where each bag is defined by first and second plies of the web, first and second side edges of the web that hermetically join the first and second plies, a preformed seal extending between the first and second side edges, a line of separation in the first ply extending between the first and second side edges, and a line of weakness in the second ply extending between the first and second side edges, the method comprising:

a) moving one of the web and a single seal bar relative to the other to a first position that corresponds to a desired boundary of a first compartment;

b) moving the first ply away from the second ply at the line of separation to form a bag opening;

c) inserting a selected one of a product and a header into the bag through the opening;

d) with the single seal bar, sealing the first and second plies together to form the first compartment that contains the selected one;

e) inserting an other of the product and the header into the bag through the opening;

f) moving the one of the web and the single seal bar to a second position that corresponds to a desired boundary of a second compartment, wherein the step of moving the one of the web and the single seal bar to a second position is performed by indexing the web to a second position;

g) with the single seal bar, sealing the first and second plies together to form the second compartment that contains the other; and h) breaking the second ply along the line of weakness to separate the package from the elongated web of interconnected bags.

2. The method of claim 1 wherein product is disposed in the first compartment.

3. The method of claim 1 wherein the header is disposed in the first compartment.

4. The method of claim 1 wherein the second ply is broken by clamping the bag with the inserted header and pulling the web of preformed bags away from the bag with the inserted header.

5. The method of claim 1 wherein the second ply is broken by clamping the bag with the inserted header and pulling the web of preformed bags away from the bag with the inserted header by rotating a pair of nip rollers.

6. The method of claim 1 wherein the first compartment is hermetically sealed.

7. The method of claim 1 wherein the second compartment is hermetically sealed.

8. The method of claim 1 wherein the bag is positioned with respect to the single seal bar by indexing the web with a pair of nip rollers.

9. The method of claim 8 wherein the bag is positioned to make the second seal by indexing the web to move the bag away from the pair of nip rollers.

10. The method of claim 8 wherein the bag is positioned to make the second seal by indexing the web to move the bag toward the pair of nip rollers.

11. The method of claim 1 further comprising repeating the method to form additional packages with internal headers from the elongated web of preformed bags.

12. The method of claim 1 further comprising punching a hole though the preformed bag and wherein a hole in the header overlaps with a hole in the bag.

13. The method of claim 1 wherein the preformed bag includes a preformed hole that overlaps with a hole in the header.

14. The method of claim 1 wherein the line of separation comprises a line of broken perforations.

15. The method of claim 1 wherein the line of separation comprises an elongated cut.

16. The method of claim 1 wherein the line of separation comprises a line of weakness that breaks when the first ply is moved away from the second ply.

17. The method of claim 1 wherein the step of moving the one of the web and the single seal bar to a second position is performed by moving the single seal bar to a second position.

18. The method of claim 1 comprising the step of fixing a relative size of the first and second compartments by adjusting a distance moved by the one of the web and the single seal bar between the first and second positions.

19. The method of claim 1 wherein the single seal bars forms a single line seal that extends longitudinally between the first and second side edges.

20. A method of making packages with an internal header from an elongated web of preformed interconnected bags, where each bag is defined by first and second plies of the web, first and second side edges of the web that hermetically join the first and second plies, a preformed seal extending from the first side edge to the second side edge, a line of separation in the first ply extending between the first and second side edges that defines a bag opening between the web side edges, and a line of weakness in the second ply extending between the first and second side edges that connects the bag to the elongated web, the method comprising:

a) moving one of the web and a single seal bar relative to the other to a first position that corresponds to a desired boundary of a first compartment;

b) moving the first ply away from the second ply at the line of separation to expand said opening;

c) inserting a product into the bag through the opening between the web side edges;

d) with the single seal bar, sealing the first and second plies together to define a first seal that extends between the first and second web side edges and that is disposed between the preformed seal and the line of separation to form a first compartment that contains the product;

e) inserting a header into the bag through the opening between the web side edges;

f) moving the one of the web and single seal bar to a second position that corresponds to a desired boundary of a second compartment, wherein the step of moving the one of the web and the single seal bar to a second position is performed by indexing the web to a second position;

g) with the single seal bar, sealing the first and second plies together to define a second seal that extends between the first and second web side edges and that is disposed between the first seal and the line of separation to form the second compartment that contains the header;

h) breaking the second ply along the line of weakness to separate the package from the elongated web of interconnected bags.

21. The method of claim 20 wherein the first ply is moved away from the second ply by blowing air into the opening.

22. The method of claim 20 wherein the second ply is broken by clamping the bag with the inserted header and pulling the web of preformed bags away from the bag with the inserted header.

23. The method of claim 20 wherein the second ply is broken by clamping the bag with the inserted header and pulling the web of preformed bags away from the bag with the inserted header by rotating a pair of nip rollers.

24. The method of claim 20 wherein the first compartment is hermetically sealed.

25. The method of claim 20 wherein the first compartment is hermetically sealed.

26. The method of claim 20 wherein the bag is positioned with respect to the single seal bar by indexing the web with a pair of nip rollers.

27. The method of claim 26 wherein the bag is positioned to make the second seal by indexing the web to move the bag away from the pair of nip rollers.

28. The method of claim 26 wherein the bag is positioned to make the second seal by indexing the web to move the bag toward the pair of nip rollers.

29. The method of claim 20 further comprising repeating the method to form additional packages with internal headers from the elongated web of preformed bags.

30. The method of claim 20 further comprising punching a hole through the preformed bag and wherein a hole in the header overlaps with a hole in the bag.

31. The method of claim 20 wherein the preformed bag includes a preformed hole that overlaps with a hole in the header.

32. The method of claim 20 wherein the line of separation comprises a line of broken perforations.

33. The method of claim 20 wherein the line of separation comprises an elongated cut.

34. The method of claim 20 wherein the step of moving the one of the web and the single seal bar to a second position is performed by moving the single seal bar to a second position.

35. The method of claim 20 comprising the step of fixing a relative size of the first and second compartments by adjusting a distance a distance moved by the one of the web and the single seal bar between the first and second positions.

36. The method of claim 20 wherein the single seal bars forms a single line seal that extends longitudinally between the first and second side edges.

37. An apparatus for making packages with an internal header comprising:

a) a supply of an elongated web of preformed interconnected bags, where each bag is defined by first and second plies of the web, first and second side edges of the web that hermetically join the first and second plies, a preformed seal extending between the first and second side edges, a line of separation in the first ply extending between the first and second side edges, and a line of weakness in the second ply extending between the first and second side edges;

b) an indexing mechanism positioned to receive the web from the supply and move the web along a path of travel;

c) an opening arrangement positioned along the path of travel to move the first ply away from the second ply at the line of separation to form a bag opening;

d) a product loading mechanism positioned along the path of travel for loading product into the bag opening;

e) a header loading mechanism positioned along the path of travel for loading a header into the bag opening;

f) a single seal bar positioned along the path of travel for providing seals between the first and second plies between the first and second side edges;

g) a controller in communication with the indexing mechanism, the opening arrangement, the product loading mechanism, the header loading mechanism, and the single seal bar, wherein the controller is programmed to:

i) position the bag of the web of bags at a bag opening position with the indexing mechanism, wherein the bag opening position positions the web with respect to the single seal bar in a first position that corresponds to a desired boundary of a first compartment;

ii) open the bag with the opening arrangement;

iii) insert a selected one of the product and the header into the bag with the corresponding product loading mechanism or header loading mechanism;

iv) position the bag at a first seal position with the indexing mechanism where the single seal bar makes a first seal to form the first compartment;

iv) seal the first and second plies together to form the first compartment that contains the selected one with the single seal bar;

v) insert an other of the product and the header into the bag with the corresponding product loading mechanism or header loading mechanism;

vi) position one of the web and single seal bar to a second position that corresponds to a desired boundary of a second compartment;

vii) with the single seal bar, seal the first and second plies together to form the second compartment that contains the other of the product and the header with the single seal bar.

38. The apparatus of claim 37 wherein the controller is programmed to position the bag at a second seal position with the indexing mechanism where the single seal bar makes a second seal to form the second compartment.

39. The apparatus of claim 37 wherein the controller is programmed to clamp the bag with the single seal bar and pull the web away from the bag to beak the second ply along the line of weakness to separate the package from the elongated web of interconnected bags with the indexing mechanism.

40. The method of claim 37 wherein the controller is programmed to position the one of the web and the single seal bar to a second position by moving the single seal bar to a second position.

41. The method of claim 37 wherein the controller is programmed to fix a relative size of the first and second compartments by adjusting a distance a distance moved by the one of the web and the single seal bar between the first and second positions.

42. The apparatus of claim 37 wherein the single seal bar is configured to form a single line seal that extends longitudinally between the first and second side edges.

* * * * *